US011556074B2

(12) United States Patent
Tanaka et al.

(10) Patent No.: US 11,556,074 B2
(45) Date of Patent: Jan. 17, 2023

(54) IMAGE FORMING APPARATUS COMPRISING IMAGE BEARING MEMBER SURFACE POTENTIAL CALCULATING SECTION

(71) Applicant: KYOCERA Document Solutions Inc., Osaka (JP)

(72) Inventors: Kazunori Tanaka, Osaka (JP); Yoshihiro Yamagishi, Osaka (JP); Tamotsu Shimizu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/210,901

(22) Filed: Mar. 24, 2021

(65) Prior Publication Data

US 2021/0302859 A1 Sep. 30, 2021

(30) Foreign Application Priority Data

Mar. 25, 2020 (JP) ..... JP2020-054340
Oct. 26, 2020 (JP) ..... JP2020-178969

(51) Int. Cl.
*G03G 15/02* (2006.01)
*G03G 15/00* (2006.01)

(52) U.S. Cl.
CPC ..... *G03G 15/0266* (2013.01); *G03G 15/5037* (2013.01)

(58) Field of Classification Search
CPC ..... G03G 15/065; G03G 15/0266; G03G 15/5037; G03G 15/5041
See application file for complete search history.

(56) References Cited

U.S. PATENT DOCUMENTS

2008/0253780 A1* 10/2008 Nishimura et al. .... G03G 15/08 399/27
2017/0160668 A1* 6/2017 Fujihara ..... G03G 15/0266

FOREIGN PATENT DOCUMENTS

JP 2003-295540 * 10/2003 ..... G03G 15/00
JP 2003-295540 A 10/2003

* cited by examiner

*Primary Examiner* — Arlene Heredia
(74) *Attorney, Agent, or Firm* — Studebaker & Brackett PC

(57) ABSTRACT

An image forming apparatus includes: a development device which develops an electrostatic latent image formed on a photosensitive drum into a toner image; a charger which charges the photosensitive drum; a development power supply which applies a prescribed bias voltage to the development device; and a calculating section which calculates a surface potential of the photosensitive drum based on a development current flowing in the development device. The calculating section calculates, as the surface potential, a bias voltage at which a non-charging development current that flows in the development device in an uncharged state in which the charger has not charged the photosensitive drum is equal to a charging development current that flows in the development device in a charged state in which the charger has charged the photosensitive drum.

5 Claims, 10 Drawing Sheets

| | Charging bias [V] | Bias voltage [V] | Development current [μA] |
|---|---|---|---|
| Non-charging development current | 0 | 0 | 1.10 |
| Charging development current | 900 | 180 | 0.57 |
| | 900 | 200 | 0.68 |
| | 900 | 220 | 1.00 |
| | 900 | 240 | 1.60 |

IMAGE FORMING APPARATUS COMPRISING IMAGE BEARING MEMBER SURFACE POTENTIAL CALCULATING SECTION

INCORPORATION BY REFERENCE

The present application claims priority under 35 U.S.C. § 119 to Japanese Patent Application No. 2020-054340, filed on Mar. 25, 2020, and Japanese Patent Application No. 2020-178969, filed on Oct. 26, 2020. The contents of these applications are incorporated herein by reference in their entirety.

BACKGROUND

The present disclosure relates to an image forming apparatus.

In electrographic image forming apparatuses such as copiers or printers, an image formation process is widely used in which toner is attached to an electrostatic latent image formed by irradiating the uniformly charged surface of a photosensitive drum (image bearing member) with light to develop the electrostatic latent image into a toner image. To obtain a high-quality image, it is necessary to perform development using a development bias with an adequate potential difference from the surface potential of the photosensitive drum.

To that end, it is necessary to detect the actual surface potential of the photosensitive drum when forming an image, and the surface potential of the photosensitive drum has conventionally been detected using a surface potential sensor.

However, a surface potential sensor is problematic in that it is high in cost and cannot measure accurately once scattered toner or the like attaches to the photosensitive drum. Therefore, a technique of obtaining the surface potential of a photosensitive drum without using a high-cost sensor such as a surface potential sensor is offered.

For example, an electrophotographic apparatus obtains the surface potential of a photosensitive member by forming a pulse-shaped electrostatic potential pattern on the photosensitive member, applying a bias to a development roller, and measuring the electric current flowing into the development roller from the photosensitive member when the electrostatic potential pattern is developed. Specifically, the surface potential of the photosensitive member is estimated by monitoring the electric current in the alternating points of the pulse-shaped electrostatic potential pattern. In this manner, the surface potential of the photosensitive member can be obtained without using a surface potential sensor.

SUMMARY

An image forming apparatus according to an aspect of the present disclosure includes an image bearing member, a charger, a development device, a development power supply, an electric current measuring section, and a calculating section. The image bearing member has a surface on which an electrostatic latent image is formed. The charger charges the image bearing member. The development device develops the electrostatic latent image formed on the image bearing member into a toner image by supplying a toner to the image bearing member. The development power supply applies a prescribed bias voltage to the development device. The electric current measuring section measures a development current flowing in the development device. The calculating section calculates a surface potential of the image bearing member based on the development current measured by the electric current measuring section. The electric current measuring section measures a non-charging development current that flows in the development device in an uncharged state in which the charger has not charged the image bearing member. The electric current measuring section measures a charging development current that flows in the development device in a charged state in which the charger has charged the image bearing member. The calculating section calculates, as the surface potential, a bias voltage at which the charging development current is equal to the non-charging development current.

DETAILED DESCRIPTION

Figure 1:
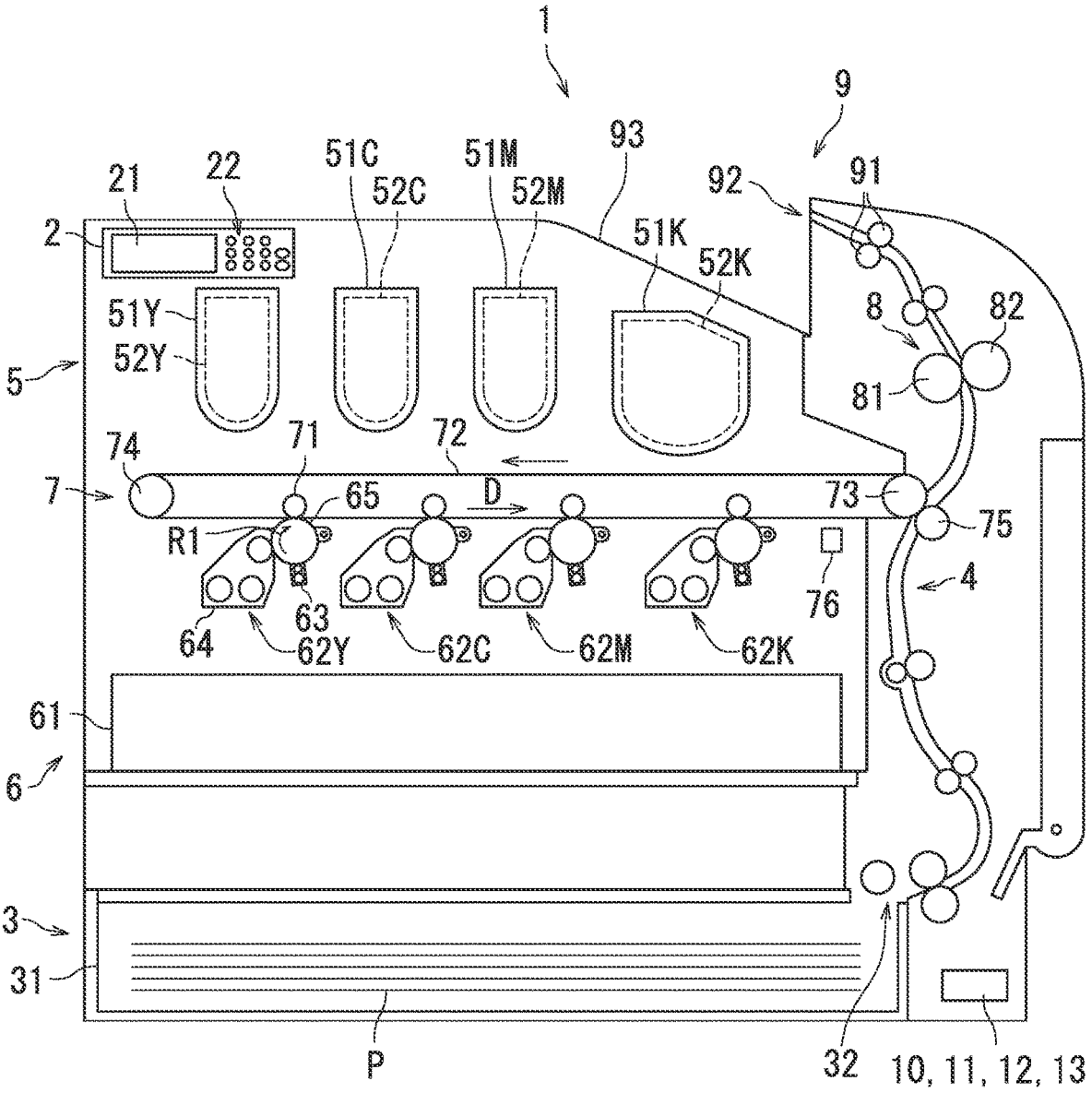
FIG. 1 is a diagram illustrating an example of a configuration of an image forming apparatus according to an embodiment of the present disclosure.

The following describes an embodiment of the present disclosure with reference to the accompanying drawings. Note that elements that are the same or equivalent are labeled with the same reference signs in the drawings and description thereof is not repeated.

A configuration of an image forming apparatus 1 according to the embodiment of the present disclosure is described with reference to FIG. 1. FIG. 1 is a diagram illustrating an example of the configuration of the image forming apparatus 1. The image forming apparatus 1 is a tandem color printer, for example.

As illustrated in FIG. 1, the image forming apparatus 1 includes an operation section 2, a sheet feed section 3, a conveyance section 4, a toner replenishing section 5, an image forming section 6, a transferring section 7, a fixing section 8, an ejection section 9, and a controller 10.

The operation section 2 receives an instruction from a user. Upon receiving the instruction from the user, the operation section 2 sends a signal indicating the instruction from the user to the controller 10. The operation section 2 includes a liquid-crystal display 21 and a plurality of operation keys 22. The liquid-crystal display 21 displays various processing results, for example. The operation keys 22 include a numeric keypad and a start key, for example. When an instruction indicating execution of image formation processing is input, the operation section 2 sends a signal indicating execution of the image formation processing to the controller 10. As a result, an image formation operation by the image forming apparatus 1 is started.

The sheet feed section 3 includes a sheet feed cassette 31 and a sheet feed roller group 32. The sheet feed cassette 31 houses a plurality of sheets P. The sheet feed roller group 32 feeds the sheets P housed in the sheet feed cassette 31 a sheet at a time to the conveyance section 4. A sheet P is an example of a recording medium.

The conveyance section 4 includes a roller and a guide member. The conveyance section 4 extends from the sheet feed section 3 to the ejection section 9. The conveyance section 4 conveys a sheet P from the sheet feed section 3 to the ejection section 9 by way of the image forming section 6 and the fixing section 8.

The toner replenishing section 5 replenishes the image forming section 6 with toner. The toner replenishing section 5 includes a first attachment section 51Y, a second attachment section 51C, a third attachment section 51M, and a fourth attachment section 51K. The toner replenishing section 5 is an example of a developer supplying section. The toner is an example of a developer.

A first toner container 52Y is attached to the first attachment section 51Y. Similarly, a second toner container 52C is attached to the second attachment section 51C, a third toner container 52M is attached to the third attachment section 51M, and a fourth toner container 52K is attached to the fourth attachment section 51K. Note that the configurations of the first to fourth attachment sections 51Y to 51K are the same as each other aside from different types of toner container being attached thereto. As such, the first to fourth attachment sections 51Y to 51K may be generically referred to as an "attachment section 51".

The first toner container 52Y, the second toner container 52C, the third toner container 52M, and the fourth toner container 52K contain respective toners. In the present embodiment, the first toner container 52Y contains a yellow toner. The second toner container 52C contains a cyan toner. The third toner container 52M contains a magenta toner. The fourth toner container 52K contains a black toner.

The image forming section 6 includes a light exposure device 61, a first image forming unit 62Y, a second image forming unit 62C, a third image forming unit 62M, and a fourth image forming unit 62K.

Each of the first to fourth image forming units 62Y to 62K includes a charger 63, a development device 64, and a photosensitive drum 65. The photosensitive drum 65 is an example of an image bearing member.

The charger 63 and the development device 64 are arranged along the peripheral surface of the photosensitive drum 65. In the present embodiment, the photosensitive drum 65 rotates in a (clockwise) direction indicated by an arrow R1 in FIG. 1.

The charger 63 uniformly charges the photosensitive drum 65 to a prescribed polarity by electrical discharge. In the present embodiment, the charger 63 charges the photosensitive drum 65 to a positive polarity. The light exposure device 61 emits laser light to the charged photosensitive drum 65. In this manner, an electrostatic latent image is formed on the surface of the photosensitive drum 65.

The development device 64 develops the electrostatic latent image formed on the surface of the photosensitive drum 65 into a toner image. The development device 64 is replenished with a toner from the toner replenishing section 5. The development device 64 supplies the toner supplied from the toner replenishing section 5 to the surface of the photosensitive drum 65. As a result, a toner image is formed on the surface of the photosensitive drum 65.

In the present embodiment, the development device 64 in the first image forming unit 62Y is connected to the first attachment section 51Y. Accordingly, the yellow toner is supplied to the development device 64 in the first image forming unit 62Y. Accordingly, a yellow toner image is formed on the surface of the photosensitive drum 65 in the first image forming unit 62Y.

The development device 64 in the second image forming unit 62C is connected to the second attachment section 51C. Accordingly, the cyan toner is supplied to the development device 64 in the second image forming unit 62C. Accordingly, a cyan toner image is formed on the surface of the photosensitive drum 65 in the second image forming unit 62C.

The development device 64 in the third image forming unit 62M is connected to the third attachment section 51M. Accordingly, the magenta toner is supplied to the development device 64 in the third image forming unit 62M. Accordingly, a magenta toner image is formed on the surface of the photosensitive drum 65 in the third image forming unit 62M.

The development device 64 in the fourth image forming unit 62K is connected to the fourth attachment section 51K. Accordingly, the black toner is supplied to the development device 64 in the fourth image forming unit 62K. Accordingly, a black toner image is formed on the surface of the photosensitive drum 65 in the fourth image forming unit 62K.

The transferring section 7 transfers the toner images formed on the surfaces of the respective photosensitive drums 65 in the first to fourth image forming units 62Y to 62K to a sheet P in a superimposed manner. In the present embodiment, the transferring section 7 transfers the toner images to the sheet P in a superimposed manner by secondary transfer. In detail, the transferring section 7 includes four primary transfer rollers 71, an intermediate transfer belt 72, a drive roller 73, a driven roller 74, a secondary transfer roller 75, and a density sensor 76.

The intermediate transfer belt 72 is an endless belt stretched between the four primary transfer rollers 71, the drive roller 73, and the driven roller 74. The intermediate transfer belt 72 is driven according to the rotation of the drive roller 73. In FIG. 1, the intermediate transfer belt 72 circles counterclockwise. The driven roller 74 is driven to rotate according to the circling of the intermediate transfer belt 72.

The first to fourth image forming units 62Y to 62K are arranged opposite to a lower surface of the intermediate transfer belt 72 in a moving direction D of the lower surface of the intermediate transfer belt 72. In the present embodiment, the first to fourth image forming units 62Y to 62K are arranged in order from upstream to downstream in the moving direction D of the lower surface of the intermediate transfer belt 72.

Each of the primary transfer rollers 71 is arranged opposite to a corresponding photosensitive drum 65 with the intermediate transfer belt 72 therebetween and pressed against the photosensitive drum 65. As such, the toner image formed on the surface of each photosensitive drum 65 is sequentially transferred to the intermediate transfer belt 72. In the present embodiment, the yellow toner image, the cyan toner image, the magenta toner image, and the black toner image are transferred in the stated order to the intermediate transfer belt 72 in a superimposed manner. In the following, a toner image generated by superimposing the yellow toner image, the cyan toner image, the magenta toner image, and the black toner image may be referred to as a "layered toner image".

The secondary transfer roller 75 is arranged opposite to the drive roller 73 with the intermediate transfer belt 72 therebetween. The secondary transfer roller 75 is pressed against the drive roller 73. Accordingly, a transfer nip is formed between the secondary transfer roller 75 and the drive roller 73. When the sheet P passes through the transfer nip, the layered toner image on the intermediate transfer belt 72 is transferred to the sheet P. In the present embodiment, the yellow toner image, the cyan toner image, the magenta toner image, and the black toner image are transferred to the sheet P so as to be superimposed in the stated order from a top layer to a bottom layer. The sheet P to which the layered toner image has been transferred is conveyed to the fixing section 8 by the conveyance section 4.

The density sensor 76 is arranged opposite to the intermediate transfer belt 72 downstream of the first to fourth image forming units 62Y to 62K and measures the density of the layered toner image formed on the intermediate transfer belt 72. Note that the density sensor 76 may measure the density of the layered toner image on the photosensitive drum 65 or may measure the density of the toner image fixed to the sheet P.

The fixing section 8 includes a heating member 81 and a pressure member 82. The heating member 81 and the pressure member 82 are arranged opposite to each other and form a fixing nip. The sheet P conveyed from the image forming section 6 receives pressure while being heated to a prescribed temperature by passing through the fixing nip. As a result, the layered toner image is fixed to the sheet P. The sheet P is conveyed from the fixing section 8 to the ejection section 9 by the conveyance section 4.

The ejection section 9 includes an ejection roller pair 91 and an exit tray 93. The ejection roller pair 91 conveys the sheet P to the exit tray 93 through an exit port 92. The exit port 92 is formed in an upper part of the image forming apparatus 1.

The controller 10 controls the operation of each element included in the image forming apparatus 1. The controller 10 includes a processor 11, storage 12, and an estimating section 13. The processor 11 includes a central processing unit (CPU) for example. The storage 12 includes memory such as semiconductor memory and may include a hard disk drive (HDD). The storage 12 stores a control program therein. The processor 11 controls the operation of the image forming apparatus 1 by executing the control program. For example, the processor 11 functions as the estimating section 13 by executing the control program. The estimating section 13 estimates an amount of toner moved due to later-described fogging.

Figure 2:
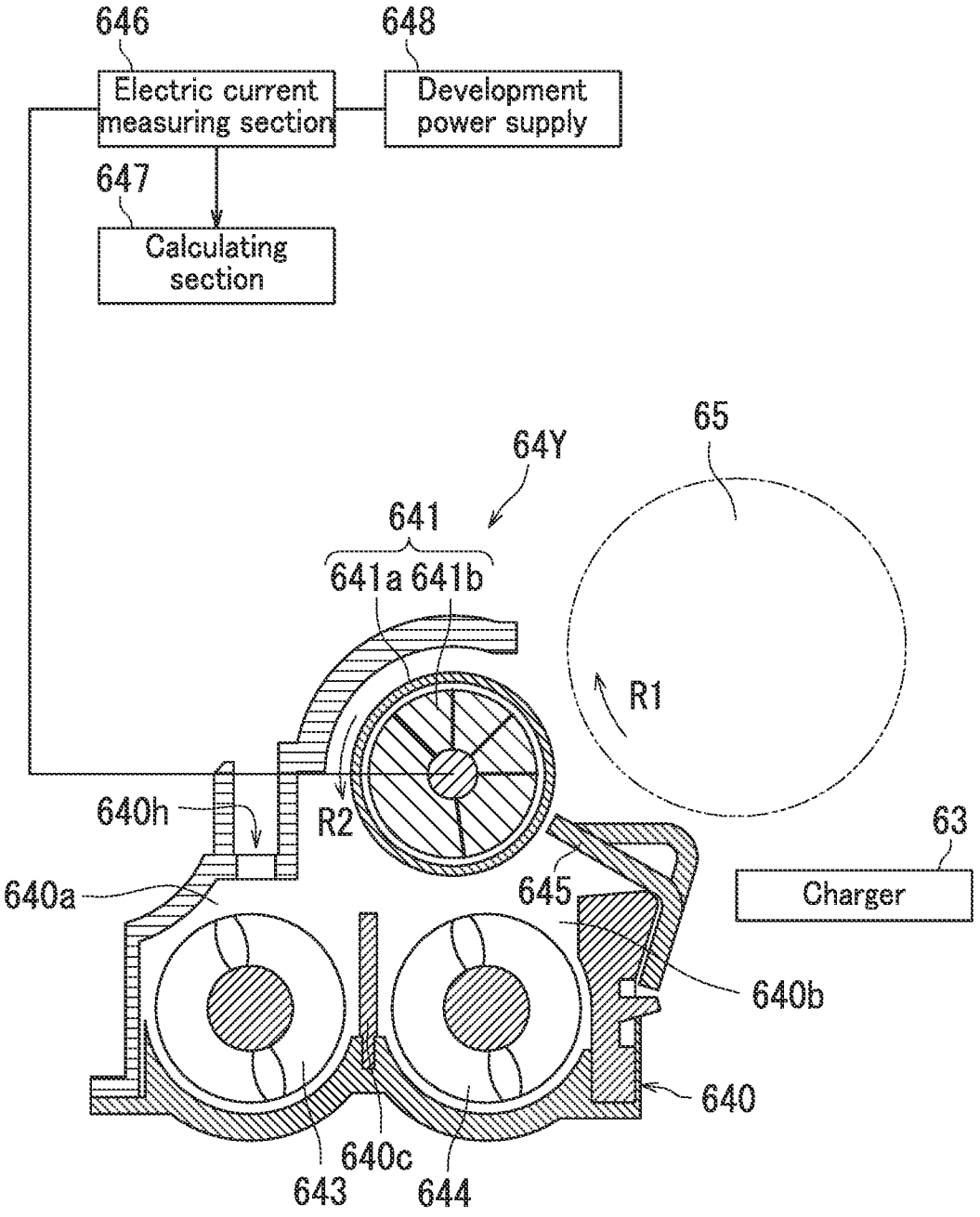
FIG. 2 is a diagram illustrating an example of a configuration of a development device in the embodiment.

Next, a configuration of a development device 64 is described in detail with reference to FIG. 2. FIG. 2 is a diagram illustrating an example of the configuration of the development device 64. In detail, FIG. 2 illustrates the first development device 64Y in the first image forming unit 62Y. Note that in FIG. 2, the photosensitive drum 65 is illustrated with a dashed and double dotted line to facilitate understanding. In the present embodiment, the first development device 64Y develops an electrostatic latent image formed on the surface of the photosensitive drum 65 using two-component development. A developer container 640 of the first development device 64Y is connected to the first toner container 52Y. Accordingly, the yellow toner is supplied to the developer container 640 of the first development device 64Y through a toner replenishment port 640*h*.

As illustrated in FIG. 2, the first development device 64Y includes a development roller 641, a first stirring screw 643, a second stirring screw 644, and a blade 645 inside the developer container 640. In detail, the development roller 641 is arranged opposite to the second stirring screw 644. The blade 645 is arranged opposite to the development roller 641.

The developer container 640 is divided into a first stirring compartment 640*a* and a second stirring compartment 640*b* by a dividing wall 640*c*. The dividing wall 640*c* extends in the axial direction of the development roller 641. The first stirring compartment 640*a* and the second stirring compartment 640*b* communicate with each other outside each of the opposite ends of the dividing wall 640*c* in a longitudinal direction thereof.

The first stirring screw 643 is arranged in the first stirring compartment 640*a*. A magnetic carrier is housed in the first stirring compartment 640*a*. A non-magnetic toner is supplied to the first stirring compartment 640*a* through the toner replenishment port 640*h*. In the example illustrated in FIG. 2, the yellow toner is supplied to the first stirring compartment 640*a*.

The second stirring screw 644 is arranged in the second stirring compartment 640*b*. A magnetic carrier is housed in the second stirring compartment 640*b*.

The yellow toner is stirred and mixed with the carrier by the first stirring screw 643 and the second stirring screw 644. As a result, a two-component developer is generated from the carrier and the yellow toner. Because the two-component developer is an example of a developer, the two-component developer may be referred to in the following simply as a "developer".

The first stirring screw 643 and the second stirring screw 644 stir the developer by circulating the developer between the first stirring compartment 640*a* and the second stirring compartment 640*b*. As a result, the toner is charged to a prescribed polarity. In the present embodiment, the toner is charged to a positive polarity.

The development roller 641 includes a non-magnetic rotating sleeve 641*a* and a magnetic body 641*b*. The magnetic body 641*b* is secured and arranged inside the rotating sleeve 641*a*. The magnetic body 641*b* has a plurality of magnetic poles. The developer is attracted to the development roller 641 through the magnetic force of the magnetic body 641*b*. As a result, a magnetic brush is formed on the surface of the development roller 641.

In the present embodiment, the development roller 641 rotates in a (counterclockwise) direction indicated by an arrow R2 in FIG. 2. The development roller 641 conveys the magnetic brush to a position opposite to the blade 645 by rotating. The blade 645 is arranged such that a gap (space) is formed between the development roller 641 and the blade 645. Accordingly, the thickness of the magnetic brush is defined by the blade 645. The blade 645 is arranged upstream in the rotational direction of the development roller 641 of a position at which the development roller 641 and the photosensitive drum 65 are opposite to each other.

A prescribed voltage is applied to the development roller 641. Thus, a layer of the developer formed on the surface of the development roller 641 is conveyed to a position opposite to the photosensitive drum 65 and the toner in the developer is attached to the photosensitive drum 65.

Specifically, the first development device 64Y further includes an electric current measuring section 646, a calculating section 647, and a development power supply 648.

The electric current measuring section 646 is connected between the development power supply 648 and the development roller 641, for example. The development power supply 648 applies a prescribed bias voltage to the development roller 641 of the first development device 64Y. The electric current measuring section 646 measures a development current flowing between the photosensitive drum 65 and the development roller 641 according to the bias voltage applied by the development power supply 648. The electric current measuring section 646 is an ammeter, for example, and measures the electric current value of the development current. The calculating section 647 includes a central processing unit (CPU), for example. The CPU functions as the calculating section 647 through the processor 11 executing the control program. Note that the CPU functioning as the calculating section 647 may be the processor 11.

Figure 3A:
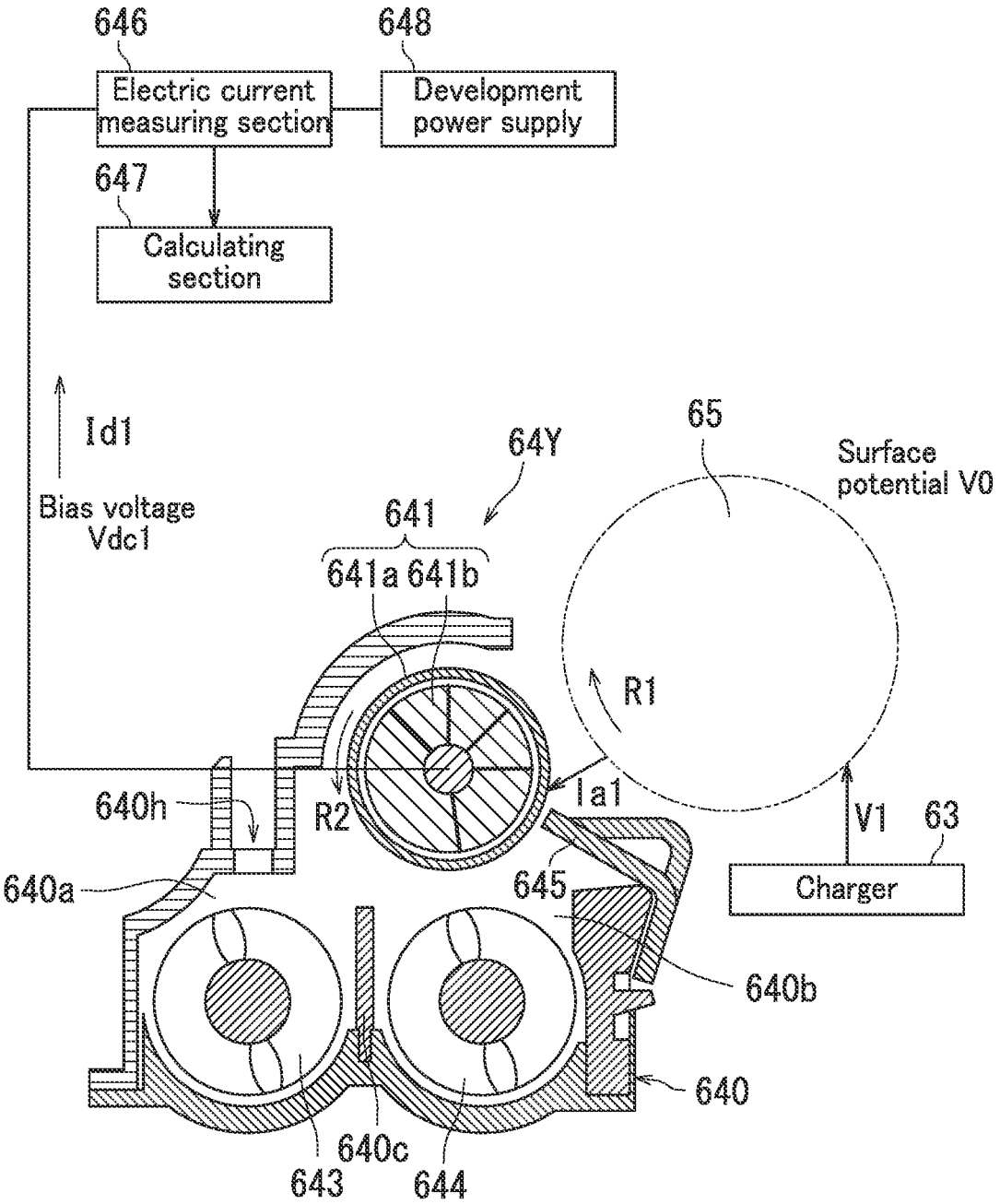
FIG. 3A is a diagram illustrating a development current measured by an electric current measuring section in the embodiment.
Figure 3B:
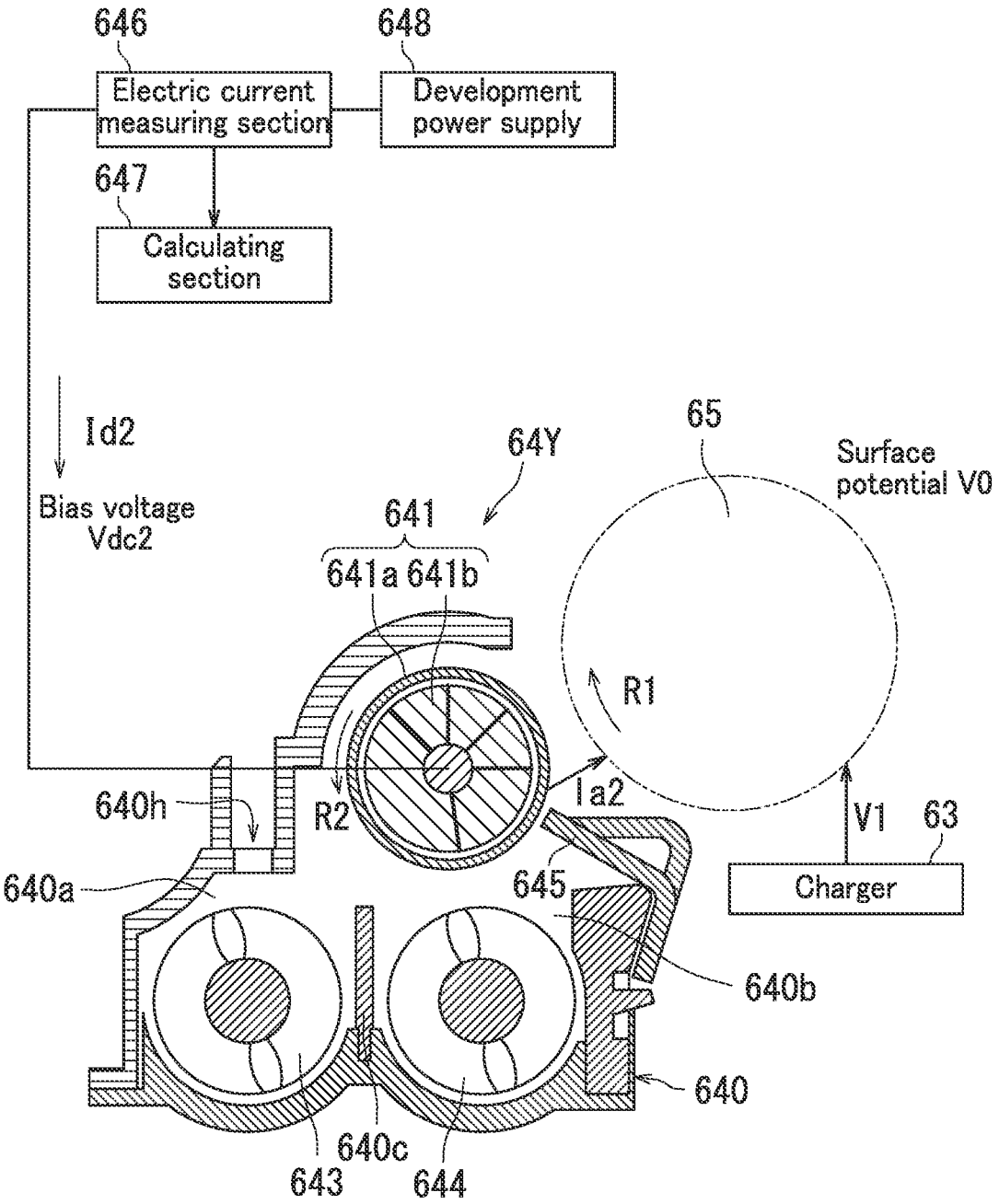
FIG. 3B is another diagram illustrating a development current measured by the electric current measuring section.

Next, the development current flowing in the first development device 64Y is described with reference to FIGS. 3A and 3B. FIGS. 3A and 3B are diagrams illustrating the development current measured by the electric current measuring section 646.

For example, the electric current measuring section 646 measures the electric current value of the development current while the first development device 64Y is developing an electrostatic latent image formed on the surface of the photosensitive drum 65.

In the present embodiment, when the user inputs an instruction indicating execution of image formation processing to the image forming apparatus 1, the controller 10 causes the image forming section 6 to start the image formation operation with corresponding elements included in the image forming apparatus 1. Specifically, the controller 10 controls the charger 63, the first development device 64Y, the development power supply 648, and the light exposure device 61.

The charger 63 charges the surface of the photosensitive drum 65 to a prescribed charge potential (surface potential V0) under control of the controller 10. In detail, when the charger 63 applies a charging bias to the photosensitive drum 65, the surface of the photosensitive drum 65 is charged to the surface potential V0.

The development power supply 648 applies a bias voltage to the development roller 641 under control of the controller 10. The bias voltage includes a direct current (DC) component and an alternating current (AC) component. FIG. 3A illustrates a case in which a bias voltage (Vdc1) with a DC component having a potential smaller than the surface potential V0 is applied to the development roller 641. Note that the bias voltage may not include an AC component.

The light exposure device 61 emits laser light to the photosensitive drum 65 charged to the surface potential V0 by the charger 63 under control of the controller 10. Thus, an electrostatic latent image is formed on the surface of the photosensitive drum 65.

Once an electrostatic latent image is formed on the surface of the photosensitive drum 65, the first development device 64Y develops the electrostatic latent image formed on the surface of the photosensitive drum 65 under control of the controller 10.

At this time, the electric current measuring section 646 measures the electric current value of the development current. In FIG. 3A, a development current Id1 is a combined electric current including an electric current that flows when toner in the magnetic brush formed on the development roller 641 moves to the development roller 641 and an electric current Ia1 that flows from the photosensitive drum 65 through the magnetic brush formed on the development roller 641.

FIG. 3B illustrates a case in which a bias voltage (Vdc2) with a DC component having a potential greater than the surface potential V0 is applied to the development roller 641. In FIG. 3B, a development current Id2 is a combined electric current including an electric current Ia2 that flows when the toner is supplied to the photosensitive drum 65 and an electric current flowing to the photosensitive drum 65 through the magnetic brush formed on the development roller 641.

As such, when the DC component of the bias voltage has a potential greater than the surface potential V0, the direction of the development current measured by the electric current measuring section 646 is reversed from the case in which the DC component of the bias voltage has a potential smaller than the surface potential V0.

Furthermore, when the DC component of the bias voltage has a potential equal to the surface potential V0, the development electric field intensity is zero and the development current is zero. Because of this, the potential of the DC component of the bias voltage is determined to be the surface potential V0 when the development current is zero. Therefore, in development of an electrostatic latent image, a bias voltage with an adequate potential difference can be applied to the development roller 641 and a higher quality image can be formed.

However, even when the development electric field intensity is zero in the image forming apparatus 1, a development current may be observed that is due to low-charged toner with a weak electrostatic binding force being attached to and moving on the photosensitive drum 65 (fogging).

To address this, the surface potential of the photosensitive drum 65 is estimated with consideration to a development current and the like caused by fogging as above in the present embodiment.

Specifically, in the present embodiment, the surface potential of the photosensitive drum 65 is calculated by referring to the electric current that flows when toner moves from the development roller 641 to the photosensitive drum 65 in a state in which the development electric field intensity is zero.

Figure 4:
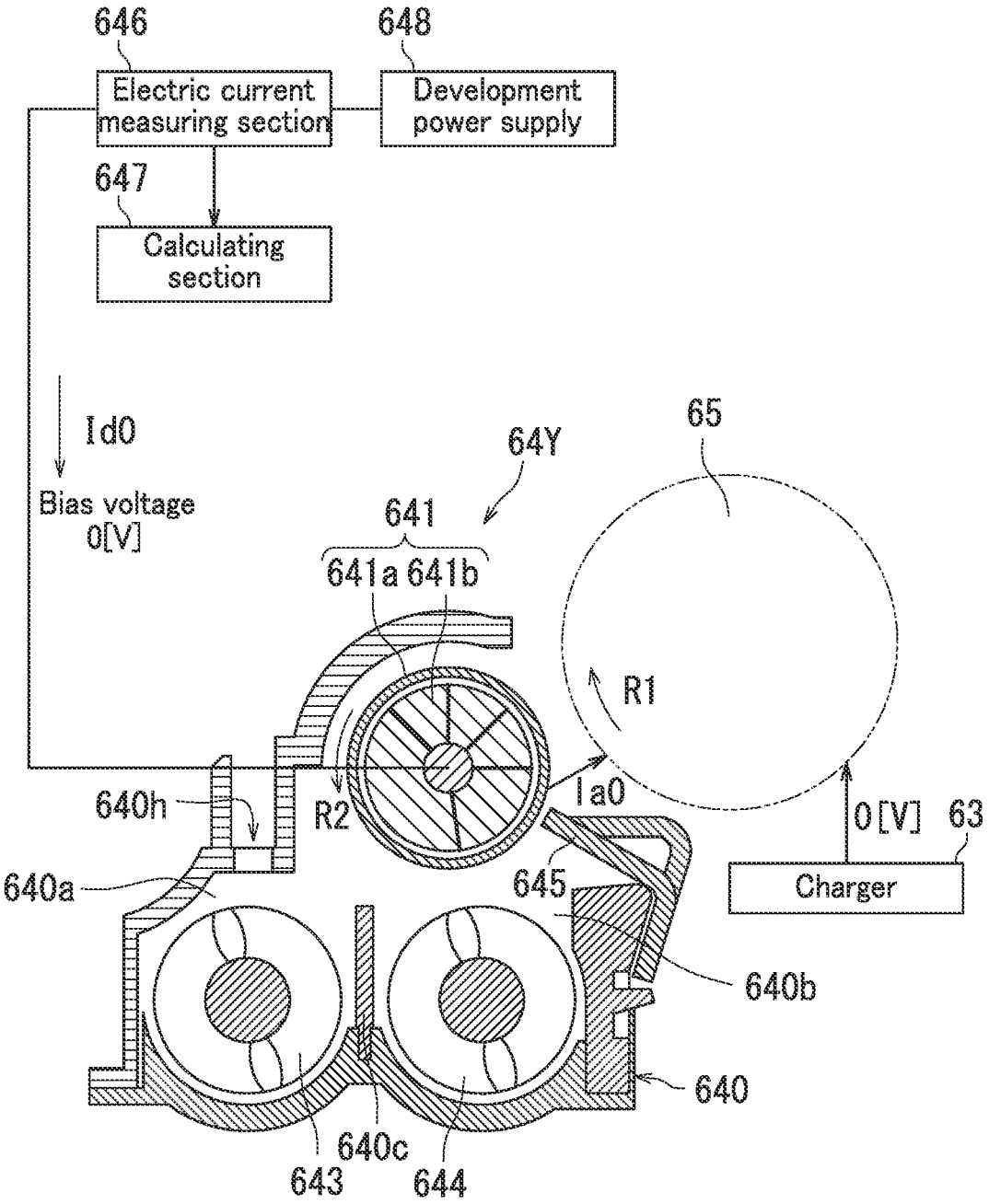
FIG. 4 is a diagram illustrating a non-charging development current measured by the electric current measuring section.

Next, an electric current (non-charging development current) used as a reference is described with reference to FIG. 4. FIG. 4 is a diagram illustrating a non-charging development current measured by the electric current measuring section 646. The non-charging development current is a current flowing in the first development device 64Y in an uncharged state in which the charger 63 has not charged the photosensitive drum 65.

Specifically, the charger 63 does not apply a charging bias to the photosensitive drum 65 (0 V). The development power supply 648 applies a bias voltage with a DC component of 0 V to the development roller 641.

At this time, the electric current measuring section 646 measures a combined non-charging development current Id0 including the electric current Ia0 that flows when toner moves to the photosensitive drum 65 and an electric current flowing to the photosensitive drum 65 through the magnetic brush formed on the development roller 641.

Next, the image forming apparatus 1 measures the electric current value of a charging development current flowing in the first development device 64Y in a charged state in which the charger 63 has charged the photosensitive drum 65 and estimates the surface potential based on the measured value of the charging development current and the measured value of the non-charging development current.

Specifically, the calculating section 647 acquires the measured value of the charging development current and the measured value of the non-charging electric current measured by the electric current measuring section 646 and calculates the surface potential based on each measured value.

Figure 5A:
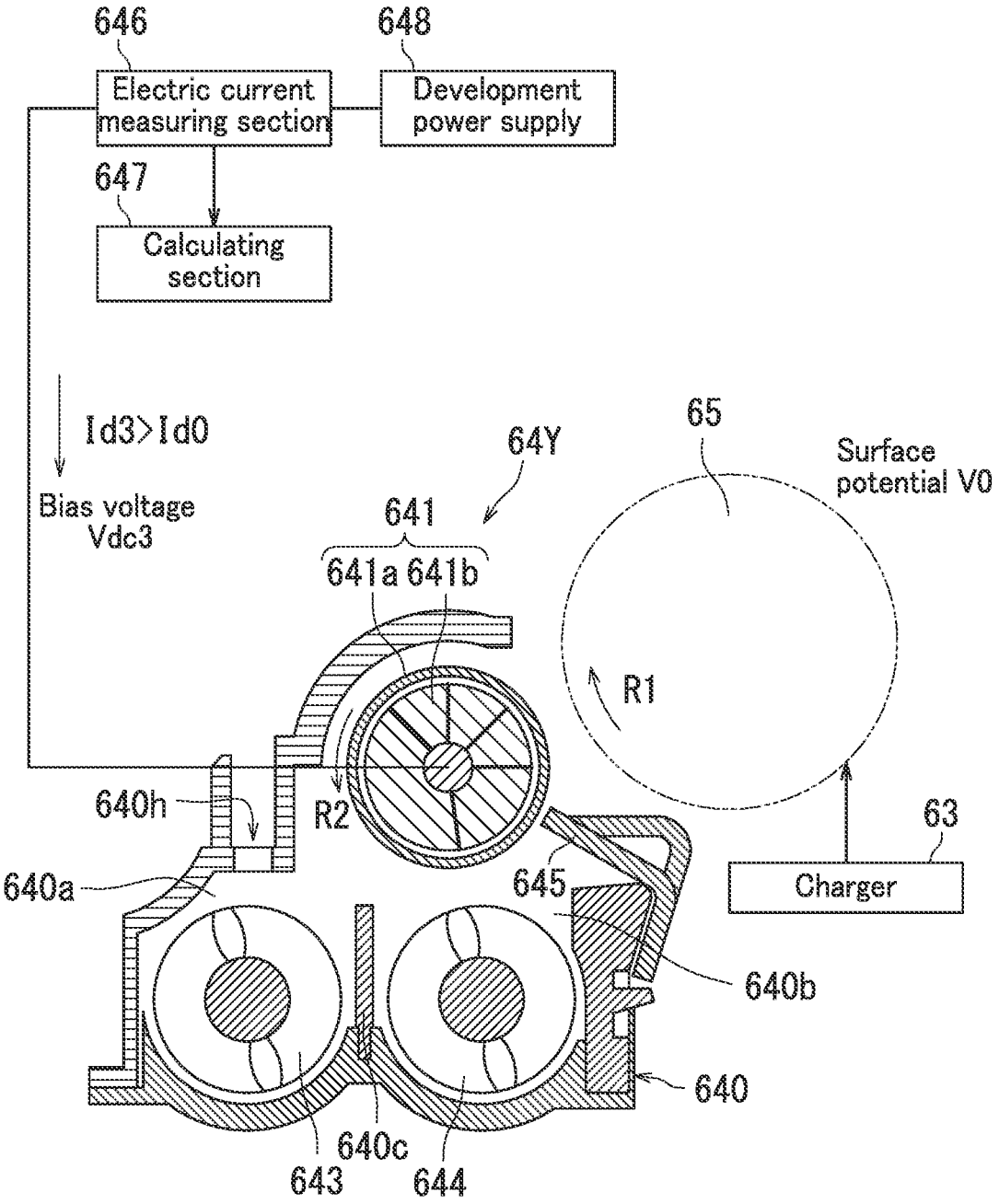
FIG. 5A is a diagram illustrating a charging development current measured by the electric current measuring section.
Figure 5B:
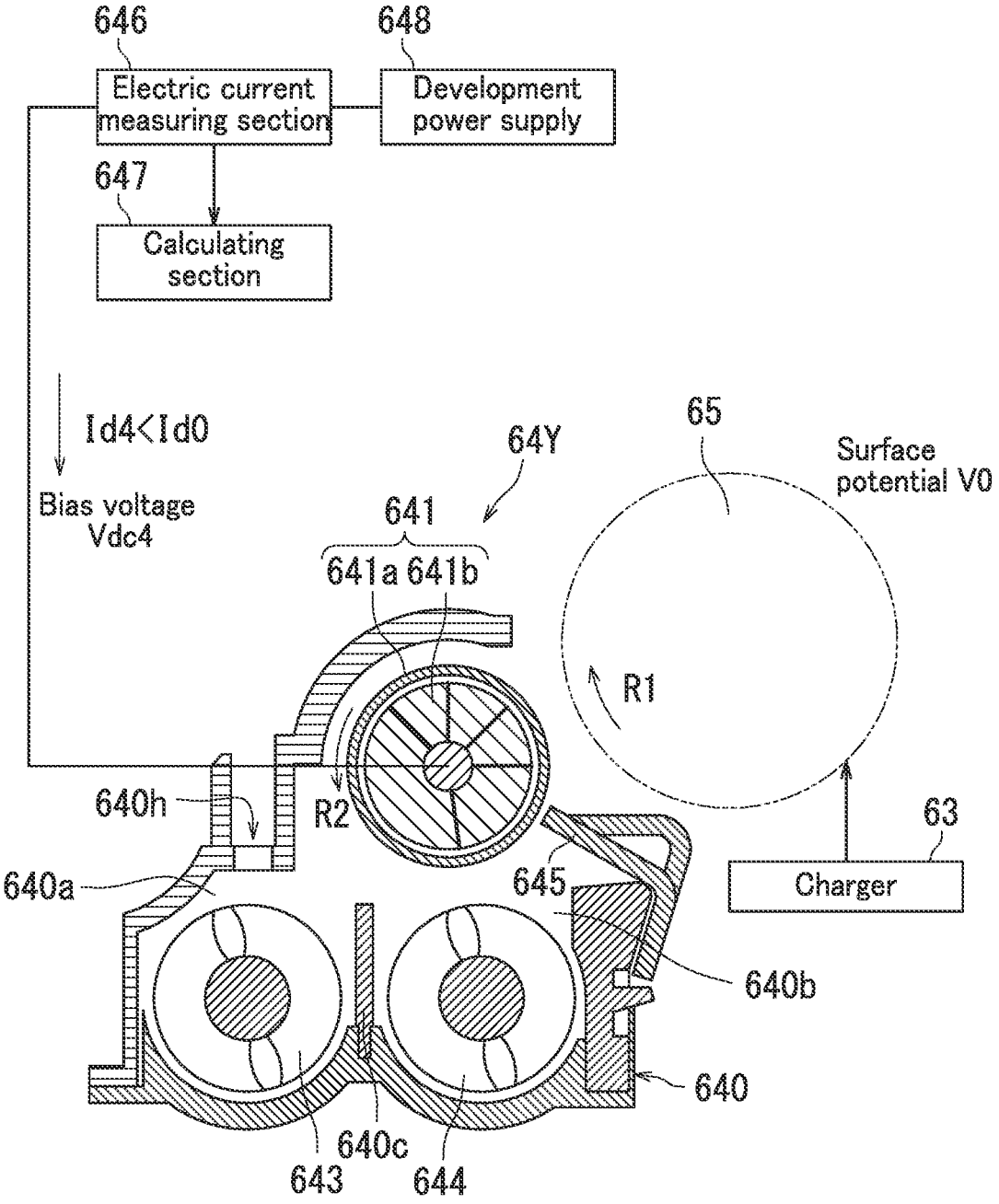
FIG. 5B is another diagram illustrating a charging development current measured by the electric current measuring section.

Next, measurement of the charging development current is described with reference to FIGS. 5A and 5B. FIGS. 5A and 5B are diagrams illustrating the charging development current measured by the electric current measuring section 646.

The charger 63 applies a charging bias to the photosensitive drum 65 to charge the surface of the photosensitive drum 65 to the surface potential V0 (FIGS. 5A and 5B).

The development power supply 648 applies a multi-stage bias voltage to the first development device 64Y. The electric current measuring section 646 measures a corresponding charging development current for each stage of the bias voltage.

For example, the development power supply 648 applies to the development roller 641 a bias voltage Vdc3 at which a charging development current Id3 larger than the non-charging development current Id0 flows. At this time, the electric current measuring section 646 measures the electric current value of the charging development current Id3. The calculating section 647 acquires the bias voltage Vdc3 being applied by the development power supply 648 and the electric current value of the charging development current Id3 measured by the electric current measuring section 646 (FIG. 5A).

Furthermore, the development power supply 648 applies to the development roller 641 a bias voltage Vdc4 at which a charging development current Id4 smaller than the non-charging development current Id0 flows. At this time, the electric current measuring section 646 measures the electric current value of the charging development current Id4. The calculating section 647 acquires the bias voltage Vdc4 being applied by the development power supply 648 and the electric current value of the charging development current Id4 measured by the electric current measuring section 646 (FIG. 5B).

Figure 6:
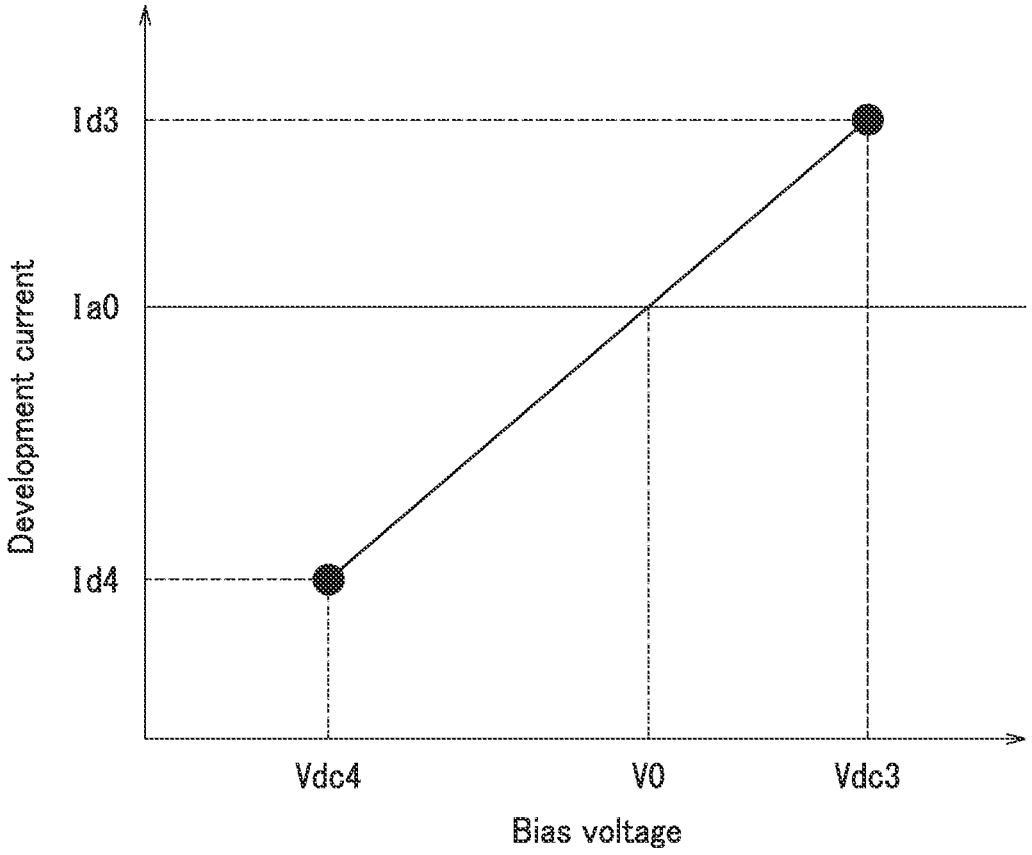
FIG. 6 is a graph illustrating a correspondence between the development current and a bias voltage.

Next, calculation of the surface potential is described with reference to FIG. 6. FIG. 6 is a graph illustrating a correspondence between the development current and the bias voltage. FIG. 6 indicates the development current on the vertical axis thereof and the bias voltage on the horizontal axis thereof.

The calculating section 647 calculates as the surface potential V0 a bias voltage at which a charging development current equal to the non-charging development current Id0 measured by the electric current measuring section 646 flows based on the bias voltage Vdc3 and charging development current Id3, and the bias voltage Vdc4 and the charging development current Id4 thus acquired.

For example, the controller 10 determines a bias voltage Vdc applied to the development roller 641 by the development power supply 648 based on the surface potential V0 calculated by the calculating section 647.

Note that the controller 10 may determine the bias voltage Vdc applied to the development roller 641 based on a surface potential obtained by a method other than calculation by the calculating section 647. For example, in a case in which image formation is performed on a plurality of sheets P, the controller 10 determines the bias voltage Vdc based on the surface potential V0 calculated by the calculating section 647 during image formation on a first sheet P and determines the bias voltage Vdc based on a predetermined surface potential or a surface potential estimated by another method during image formation on second and later sheets P.

In the present embodiment, the light exposure device 61 does not emit laser light to the photosensitive drum 65 during measurement of the non-charging development current and the charging development current by the electric current measuring section 646. As such, by performing measurement of the non-charging development current and the charging development current using an unexposed area of the photosensitive drum 65, the development current mainly includes electric current caused by the movement of carrier. This is because little toner scattering occurs in a blank area even when fogging occurs. Accordingly, the surface potential of the photosensitive drum 65 can be measured with high accuracy.

In the present embodiment, the configuration of the development devices 64 included in the respective first to fourth image forming units 62Y to 62K is substantially identical aside from the type of toner being supplied thereto from the toner replenishing sections 5. Accordingly, description of the configuration of the second to fourth development devices 64C to 64K in the respective second to fourth image forming units 62C to 62K is omitted.

(Measurement of Amount of Toner Moved Due to Fogging)

In the present embodiment, the non-charging development current increases and deviates from zero as the amount of toner moved due to fogging increases. Therefore, the difference between the actual surface potential and the measured surface potential increases when the surface potential is estimated to be equal to the potential of the DC component of the bias voltage in a case in which the development current is zero (FIGS. 3A and 3B). Furthermore, frequent measurement of the non-charging development current reduces productivity.

To this end, the estimating section 13 estimates an amount of toner moved due to fogging. For example, the estimating section 13 estimates the amount of moved toner to be great when the density of a toner image measured by the density sensor 76 is high because fogging easily occurs when the density of a toner image is high. Furthermore, the estimating section 13 may estimate whether the amount of moved toner is great or small based on not only the density of a toner image but also a plurality of parameters such as an amount of charge of the toner, an advective diffusion coefficient of the developer, a frequency of the AC component of the bias voltage, and a carrier resistance value indicating the difficulty of flow for a carrier current that flows when the carrier not including the toner flows from the photosensitive drum 65 to the development roller 641.

For example, when the estimating section 13 has estimated that the amount of moved toner is greater than a prescribed threshold, the controller 10 controls the charger 63, the first development device 64Y, and the development power supply 648 such that the surface potential is calculated based on the non-charging development current.

When the estimating section 13 has estimated that the amount of moved toner is less than the prescribed threshold by contrast, the controller 10 controls the charger 63, the first development device 64Y, and the development power supply 648 such that the surface potential is not calculated, or controls the charger 63, the first development device 64Y, and the development power supply 648 such that the surface potential is calculated with a non-charging development current of 0 A. Furthermore, in the present embodiment, when the amount of toner moved due to fogging is small, the non-charging development current may be set to zero and the surface potential may be calculated as illustrated in FIGS. 3A and 3B.

In the present embodiment, the calculating section 647 for example determines a newly calculated surface potential to be a measurement error when the calculated surface potential differs from a previously calculated surface potential by a prescribed threshold or greater. In this case, the calculating section 647 may recalculate the surface potential or may set the previously calculated surface potential as the result of calculation.

In the present embodiment, by storing the surface potential calculated by the calculating section 647, it becomes possible to observe a change in the surface potential of the photosensitive drum 65, and degradation of elements such as the charger 63 and the photosensitive drum 65 can be predicted.

Furthermore, the present embodiment features a configuration in which an unexposed area which has not been irradiated with laser light is exploited to calculate the surface potential through measurement of the non-charging development current and the charging development current, but is not limited to this configuration and may feature a configuration in which an exposed area which has been irradiated with laser light by the light exposure device 61 is exploited to calculate the surface potential through measurement of the non-charging development current and the charging development current.

Figure 7:
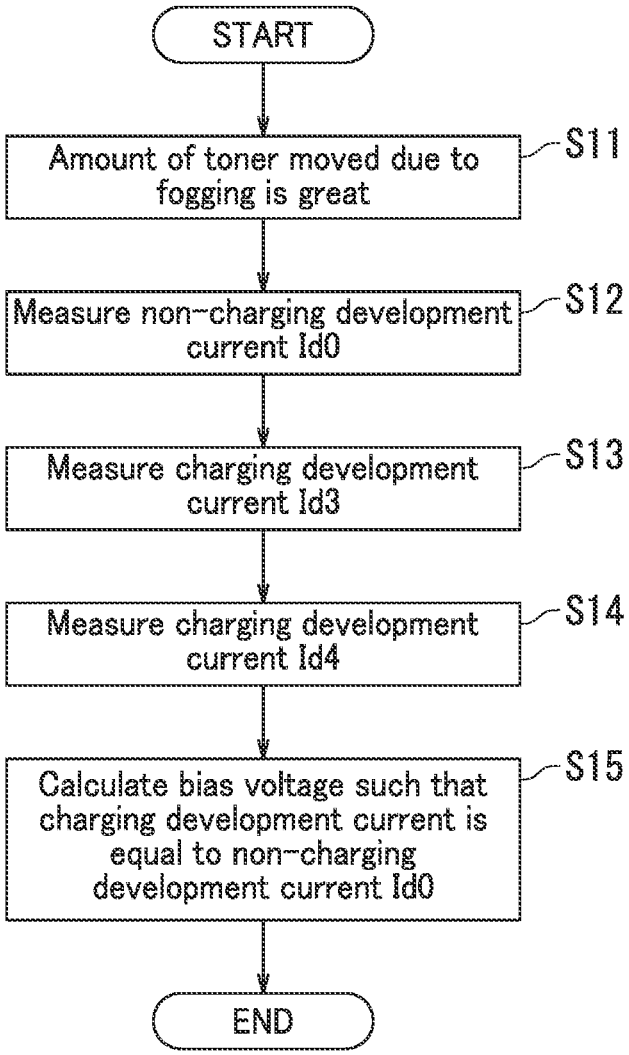
FIG. 7 is a flowchart depicting a surface potential calculation process according to the embodiment.

Next, a surface potential calculation process according to the present embodiment is described with reference to FIG. 7. FIG. 7 is a flowchart depicting the surface potential calculation process according to the present embodiment.

When the estimating section 13 estimates that the amount of toner moved due to fogging is greater than the prescribed threshold (Step S11), the electric current measuring section 646 measures the non-charging development current Id0 (Step S12).

The electric current measuring section 646 measures the charging development current Id3 that flows when a bias voltage Vdc3 at which the charging development current Id3 greater than the non-charging development current Id0 flows is applied to the development roller 641 (Step S13).

The electric current measuring section 646 measures the charging development current Id4 that flows when a bias voltage Vdc4 at which the charging development current Id4 greater than the non-charging development current Id0 flows is applied to the development roller 641 (Step S14).

The calculating section 647 calculates a bias voltage at which a charging development current equal to the non-charging development current Id0 measured by the electric current measuring section 646 flows based on the charging development current Id3 and the bias voltage Vdc4 measured by the electric current measuring section 646 (Step S15).

Note that the order of Steps S13 and S14 may be alternated.

In the present embodiment, the non-charging development current Id0 is an electric current that flows when the potential of the DC component of the bias voltage applied to the development roller 641 by the development power supply 648 is 0 V in a state in which the photosensitive drum 65 is not charged, but the non-charging development current Id0 is not limited as such.

Normally, the development current increases when the potential of the DC component of the bias voltage increases. Furthermore, an amount of change (ΔId) in the development current relative to an amount of change in the development electric field intensity is small when the development electric field intensity is small and weaker than the attachment strength of the toner to the magnetic brush. When the development electric field intensity is stronger than the attachment strength of the toner to the magnetic brush by contrast, movement of the toner becomes active and ΔId sharply increases.

Because an error in calculating the surface potential increases when ΔId is small, it is preferable for ΔId to be large in order to calculate the surface potential with high accuracy.

In view of the foregoing, in the uncharged state of the photosensitive drum 65, the development power supply 648 applies to the development roller 641 a bias voltage Vdc0 (measurement bias voltage) including a DC component at which ΔId is equal to or greater than a prescribed size. The electric current measuring section 646 measures the non-charging development current Id01 flowing while the measurement bias voltage is being applied.

The calculating section 647 calculates a bias voltage Vdc5 at which a charging development current equal to the non-charging development current Id01 flows using the method described above. The calculating section 647 subtracts the bias voltage Vdc0 from the bias voltage Vdc5 to calculate a bias voltage as the surface potential V0.

Example

Next, the present disclosure is described specifically based on Example, but the present disclosure is not limited by Example as below.

In Example of the present disclosure, a multifunction peripheral was used as the image forming apparatus 1. The multifunction peripheral was a remodeled TASKalfa 2550Ci (product of KYOCERA Document Solutions Inc.).

The testing conditions of the multifunction peripheral were as follows:

- Photosensitive drum 65: positively chargeable organic photoconductor (OPC) drum
- Thickness of photosensitive drum 65: 32 μm
- Charger 63: outer diameter of metal core of charging roller—6 mm, rubber thickness—3 mm, rubber resistance—6.0 Log Ω
- Charging bias: DC only
- Blade 645: SUS 430, magnetic
- Thickness of blade 645: 1.5 mm
- Surface profile of development roller 641: subjected to knurling and blasting
- Outer diameter of development roller 641: 20 mm
- Recesses of development roller 641: 80 rows in circumferential direction
- Peripheral speed of development roller 641/peripheral speed of photosensitive drum 65: 1.8
- Distance between development roller 641 and photosensitive drum 65: 0.30 mm
- AC component of bias voltage: Vpp 1200 V, duty 50%, rectangular waveform, 8 kHz
- Toner: particle diameter—6.8 μm, positively chargeable
- Carrier: particle diameter—38 μm, ferrite resin coated carrier Toner density: 6%

Printing speed: 55 sheets per minute

Next, the surface potential calculated in the image forming apparatus 1 according to the present example is described with reference to FIGS. 8 and 9.

Figures 8, 9:
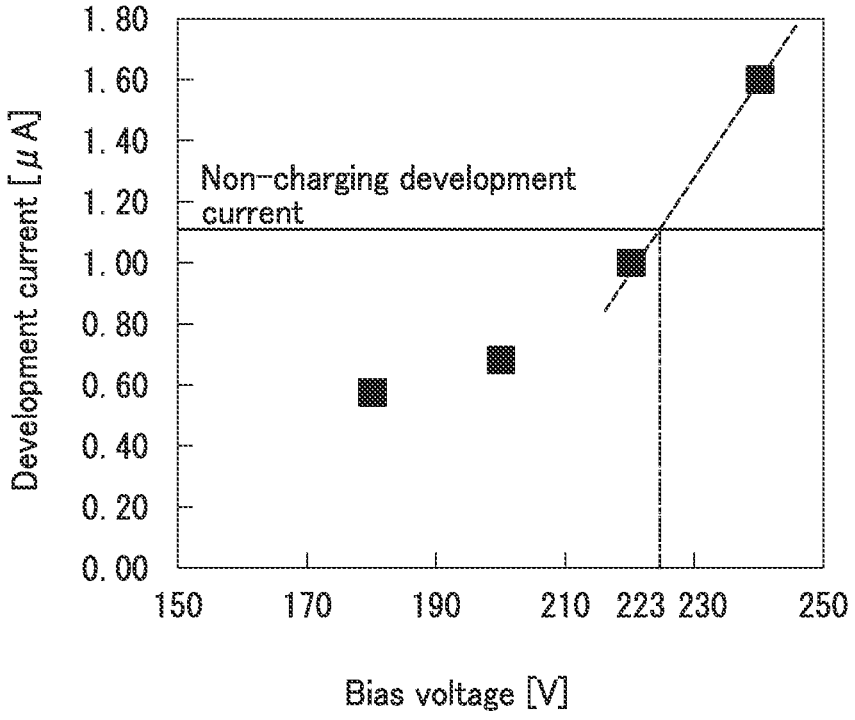
FIG. 8 is a table illustrating a measured non-charging development current, and a measured charging development current when a four-stage bias voltage with a charging bias of 900 V is applied to a development roller in the image forming apparatus according to Example of the present disclosure.
FIG. 9 is a graph illustrating the relationship between the bias voltage, the non-charging development current, and the charging development current illustrated in FIG. 8.

FIG. 8 is a table illustrating the measured non-charging development current, and the charging development current measured when a four-stage bias voltage with a charging bias of 900 V is applied to the development roller 641 in the image forming apparatus 1 according to the present example.

FIG. 9 is a graph illustrating the relationship between the bias voltage, the non-charging development current, and the charging development current illustrated in FIG. 8. FIG. 9 illustrates the development current on the vertical axis thereof, and illustrates the bias voltage on the horizontal axis thereof.

In the present example, the measured non-charging development current was 1.10 μA. When the bias voltage was 180 V, the development current (charging development current) was 0.57 μA. When the bias voltage was 200 V, the development current (charging development current) was 0.68 μA. When the bias voltage was 220 V, the development current (charging development current) was 1.00 μA. When the bias voltage was 240 V, the development current (charging development current) was 1.60 μA.

In the image forming apparatus 1 according to the present example as illustrated in FIG. 9, the surface potential was calculated as 223 V.

In the present example, the difference in the applied bias voltage was a maximum of 60 V, but is not limited as such and may be a maximum of 100 V. However, it is preferable that the difference in the applied bias voltage is approximately 50 V.

Also in the present example, the photosensitive drum 65 was a positively chargeable OPC drum, but is not limited as such and may be an amorphous silicon drum. When an amorphous silicon drum is used as the photosensitive drum 65, measurement accuracy increases because the conductivity of the photosensitive layer is higher than that of a positively chargeable OPC drum, electric current flows easily, and the carrier resistance value is low.

Also in the present example, a two-component developer was used, but the developer is not limited as such and a one-component developer may be used.

An embodiment of the present disclosure is described above with reference to the accompanying drawings (FIGS. 1 to 9). However, the present disclosure is not limited to the above embodiment and may be implemented in various manners within a scope not departing from the gist thereof. The drawings mainly illustrate various constituent elements schematically to facilitate understanding thereof. Aspects such as thickness, length, and number of the constituent elements illustrated in the drawings may differ in practice for convenience of drawing preparation. Furthermore, aspects such as material, dimension, and shape of the constituent elements illustrated in the above embodiment are examples and not particular limitations. The constituent elements may be variously altered within a scope not substantially departing from the effects of the present disclosure.

What is claimed is:

1. An image forming apparatus comprising:

an image bearing member with a surface on which an electrostatic latent image is formed;

a charger configured to charge the image bearing member;

a development device configured to develop the electrostatic latent image formed on the image bearing member into a toner image by supplying a toner to the image bearing member;

a development power supply configured to apply a prescribed bias voltage to the development device;

an electric current measuring section configured to measure a development current flowing in the development device; and a calculating section configured to calculate a surface potential of the image bearing member based on the development current measured by the electric current measuring section, wherein the electric current measuring section measures a non-charging development current that flows in the development device in an uncharged state in which the charger has not charged the image bearing member, the electric current measuring section measures a charging development current that flows in the development device in a charged state in which the charger has charged the image bearing member, the calculating section calculates, as the surface potential, a bias voltage at which the charging development current is equal to the non-charging development current, in measurement of the non-charging development current, the development power supply applies a bias voltage with no direct current components to the development device, the image forming apparatus further comprises an estimating section which estimates an amount of the toner moved due to fogging based on a density of the toner image, an amount of charge of the toner, a frequency of an AC component of the bias voltage, or a plurality of parameters including a carrier resistance value, when the estimating section estimates that the amount of the toner is greater than a prescribed threshold, the calculating section calculates the surface potential based on the non-charging development current, when the estimating section estimates that the amount of the toner is less than the prescribed threshold, the calculating section calculates, as the surface potential, the bias voltage when the charging development current does not flow, and the carrier resistance value indicates difficulty of flow for a carrier current that flows when a carrier not including the toner flows from the image bearing member to the development device.

2. The image forming apparatus according to claim 1, wherein the development power supply applies a multiple-stage bias voltage as the prescribed bias voltage to the development device, the electric current measuring section measures charging development currents corresponding to respective stages of the multi-stage bias voltage, and the calculating section calculates the surface potential based on the charging development currents corresponding to the respective stages of the multi-stage bias voltage.

3. The image forming apparatus according to claim 1, wherein at different times, the development power supply applies a bias voltage at which the charging development current flows at a greater electric current value than an electric current value of the non-charging development current, and applies a bias voltage at which the charging development current flows at a smaller electric current value than the electric current value of the non-charging development current.

4. The image forming apparatus according to claim 1, wherein the calculating section calculates the surface potential before the image forming apparatus performs image formation processing to form an image on a recording medium.

5. The image forming apparatus according to claim 1, wherein the electric current measuring section measures a development current in a state in which the image bearing member is not exposed to light.

* * * * *